US007129916B2

(12) United States Patent
Maede et al.

(10) Patent No.: US 7,129,916 B2
(45) Date of Patent: Oct. 31, 2006

(54) ORGANIC EL ELEMENT DRIVE CIRCUIT AND ORGANIC EL DISPLAY DEVICE USING THE SAME DRIVE CIRCUIT

(75) Inventors: Jun Maede, Kyoto (JP); Shinichi Abe, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 553 days.

(21) Appl. No.: 10/677,355

(22) Filed: Oct. 3, 2003

(65) Prior Publication Data

US 2005/0073486 A1 Apr. 7, 2005

(30) Foreign Application Priority Data

Oct. 7, 2002 (JP) ..... 2002-293455

(51) Int. Cl.
*G09G 3/30* (2006.01)

(52) U.S. Cl. ..... 345/76; 345/45; 345/83

(58) Field of Classification Search ..... 345/36, 345/39, 45, 46, 48, 76, 83, 84
See application file for complete search history.

(56) References Cited

U.S. PATENT DOCUMENTS 6,317,138 B1 * 11/2001 Yano et al. ..... 345/589
6,339,415 B1 * 1/2002 Ishizuka ..... 345/76
2003/0016198 A1 * 1/2003 Nagai et al. ..... 345/83

FOREIGN PATENT DOCUMENTS

JP 9-232074 9/1997
JP 2001-143867 5/2001

* cited by examiner

*Primary Examiner*—Richard Hjerpe
*Assistant Examiner*—Jean Lesperance
(74) *Attorney, Agent, or Firm*—Mattingly, Stanger, Malur & Brundidge, P.C.

(57) ABSTRACT

An organic EL element drive circuit comprises a plurality of peak current generator circuits provided correspondingly to terminal pins of an organic EL display panel, for adding peak currents corresponding to pulse widths of predetermined pulse signals and a pulse generator circuit for generating the predetermined pulse signal including a first, second and third pulses having pulse widths thereof determined according to data, which are set externally of the pulse generator circuit. The pulse generator circuit sends the first pulse to the terminal pins of the peak current generator circuits provided for R display color as the predetermined pulse, the second pulse to the peak current generator circuits provided for G display color as the predetermined pulse and the third pulse to the peak current generator circuits provided for B display color as the predetermined pulse.

15 Claims, 2 Drawing Sheets

ORGANIC EL ELEMENT DRIVE CIRCUIT AND ORGANIC EL DISPLAY DEVICE USING THE SAME DRIVE CIRCUIT

BACKGROUND OF THE INVENTION

1. Field of the Invention

The present invention relates to an organic EL (electro luminescence) element drive circuit and an organic EL display device using the same drive circuit and, in particular, the present invention relates to an organic EL display device suitable for high luminance color display, which can precisely regulate white balance on a display screen of a display device of an electronic device such as a portable telephone set or a PHS by regulating luminance of each of R (red), G (green) and B (blue) display colors regardless of smallness of dynamic range of regulation of a reference current value of each of primary colors.

2. Description of the Prior Art

An organic EL display panel of an organic EL display device mounted on a portable telephone set, a PHS, a DVD player or a PDA (personal digital assistance) and having 396 (132×3) terminal pins for column lines and 162 terminal pins for row lines has been proposed and there is a current tendency that the number of column lines and the number of row lines are further increased.

An output stage of a current drive circuit of such organic EL display panel includes an output circuit constructed with, for example, current-mirror circuits, which are provided correspondingly to the respective terminal pins, regardless of the type of drive current, the passive matrix type or the active matrix type. Incidentally, in a case of the passive matrix type drive current, the drive current has a peak value in order to emit light earlier by initially charging an organic EL element having capacitive load characteristics at light emission start time.

One of problems of the organic EL display device is that, when the voltage drive is used as in a liquid crystal display device, it is difficult to control a display because of large variation of luminance and difference in light emission sensitivity between R, G and B colors. For this reason, the organic EL display device should be current-driven. However, even when the current-drive is employed, light emission efficiency ratio of drive currents for the primary colors is, for example, R:G:B=6:11:10, which depends upon materials of the organic EL elements.

In view of this, it is necessary in the current-drive circuit for a color display that white balance is obtained on a display screen by regulating luminance of each of R, G and B colors correspondingly to materials of the EL elements for respective R, G and B display colors. In order to realize such white balance regulation, a regulation circuit for regulating luminance of each of R, G and B display colors on the display screen is provided.

Incidentally, JPH9-232074A discloses a drive circuit for organic EL element, in which each of the organic EL elements arranged in a matrix is current-driven and a terminal voltage of the organic EL element is reset by grounding an anode and a cathode of the organic EL element. Further, JP2001-143867A discloses a technique with which power consumption of an organic EL display device is reduced by current-driving organic EL elements with using DC-DC converters.

It is usual that the current-drive circuit of the organic EL display device generates drive currents for organic EL elements at respective column pins (column side terminal pins of an organic EL panel) by amplifying reference currents for R, G and B display colors and the regulation of drive-currents for obtaining white balance is performed by regulating the reference currents for R, G and B dislay colors.

In order to regulate the reference currents for R, G and B display colors, each of reference current generator circuits of a conventional drive current regulator circuit includes a D/A converter circuit of, for example, 4 bits and the reference currents for R, G and B display colors are regulated by setting a predetermined bit data for each of R, G and B display colors within a range, for example, from 30 μA to 75 μA. With the fact that various organic EL materials have been developed recently, the luminance regulation for realizing white balance, which is realizable by the D/A converter circuits, is not enough since the dynamic range of regulation is as small as 4 bits.

However, if the number of bits of the D/A converter circuit for luminance regulation of each of R, G and B display colors is increased to a value in a range, for example, from 6 bits to 8 bits in order to enlarge the dynamic range of regulation, the circuit size becomes large, so that it becomes difficult to fabricate the current drive circuits in one chip. Further, the miniaturization of a display device portion becomes impossible.

SUMMARY OF THE INVENTION

An object of the present invention is to provide an organic EL element drive circuit with which regulation of white balance on a screen of an organic EL display device of an electronic device by luminance regulation of R, G and B display colors is facilitated, and an organic EL display device using an organic EL element drive circuit, which is identical to the same organic EL element drive circuit.

Another object of the present invention is to provide an organic EL element drive circuit capable of finely regulating white balance regardless of smallness of dynamic range of a reference current for each of R, G and B display colors and an organic EL display device using an organic EL element drive circuit, which is identical to the same organic EL element drive circuit.

According to the present invention, in order to achieve the above objects, the organic EL element drive circuit for current-driving terminal pins of an organic EL display panel, which are provided correspondingly to R, G and B display colors, by supplying output currents thereto, is featured by comprising a plurality of peak current generator circuits provided correspondingly to the terminal pins, for generating a peak current corresponding to pulse width of a predetermined pulse signal, and a pulse generator circuit for generating the predetermined pulse signal, the predetermined pulse signal including a first, second and third pulses having pulse widths determined according to data, which is set externally, the first pulse being supplied to a plurality of the peak current generator circuits, which are provided correspondingly to the terminals for R display color, the second pulse to a plurality of the peak current generator circuits, which are provided correspondingly to the terminals for G display color and the third pulse to a plurality of the peak current generator circuits, which are provided correspondingly to the terminal pins for B display color.

In the present invention, widths of the first, second and third pulses generated by the pulse generator circuit are predetermined according to light emission efficiency of the R, G and B organic EL elements for R, G and B display colors and the peak current generator circuits provided correspondingly to the terminal pins corresponding to R, G and B display colors are driven by the first, second and third pulses, respectively.

Therefore, it is possible to generate the peak currents correspondingly to the pulse widths at the terminal pins for respective R, G and B display colors, so that luminance of each of the respective organic EL elements can be varied correspondingly to the time periods for which the peak currents are generated.

The pulse generator circuit may be, for example, a programmable pulse width generator circuit, the pulse width data of which are set externally. In such case, the pulse generator circuit can generate the first, second and third pulses by setting the pulse widths of the first, second and third pulses by the pulse width data.

The white balance regulation is achieved by regulating the widths of the first, second and third pulses according to luminance of each of R, G and B display colors on a display screen of the organic EL display device and regulating the peak currents to regulate luminance of each of the organic EL elements correspondingly to R, G and B display colors such that the display screen becomes white. In addition to this white balance regulation, it is possible to further regulate reference current values for respective R, G and B display colors in order to further regulate white balance. In such case, it is possible to regulate white balance regardless of dynamic ranges of regulation of the reference current values for respective R, G and B display colors or even without performing the reference current regulation.

DETAILED DESCRIPTION OF THE PREFERRED EMBODIMENTS

Figure 1:
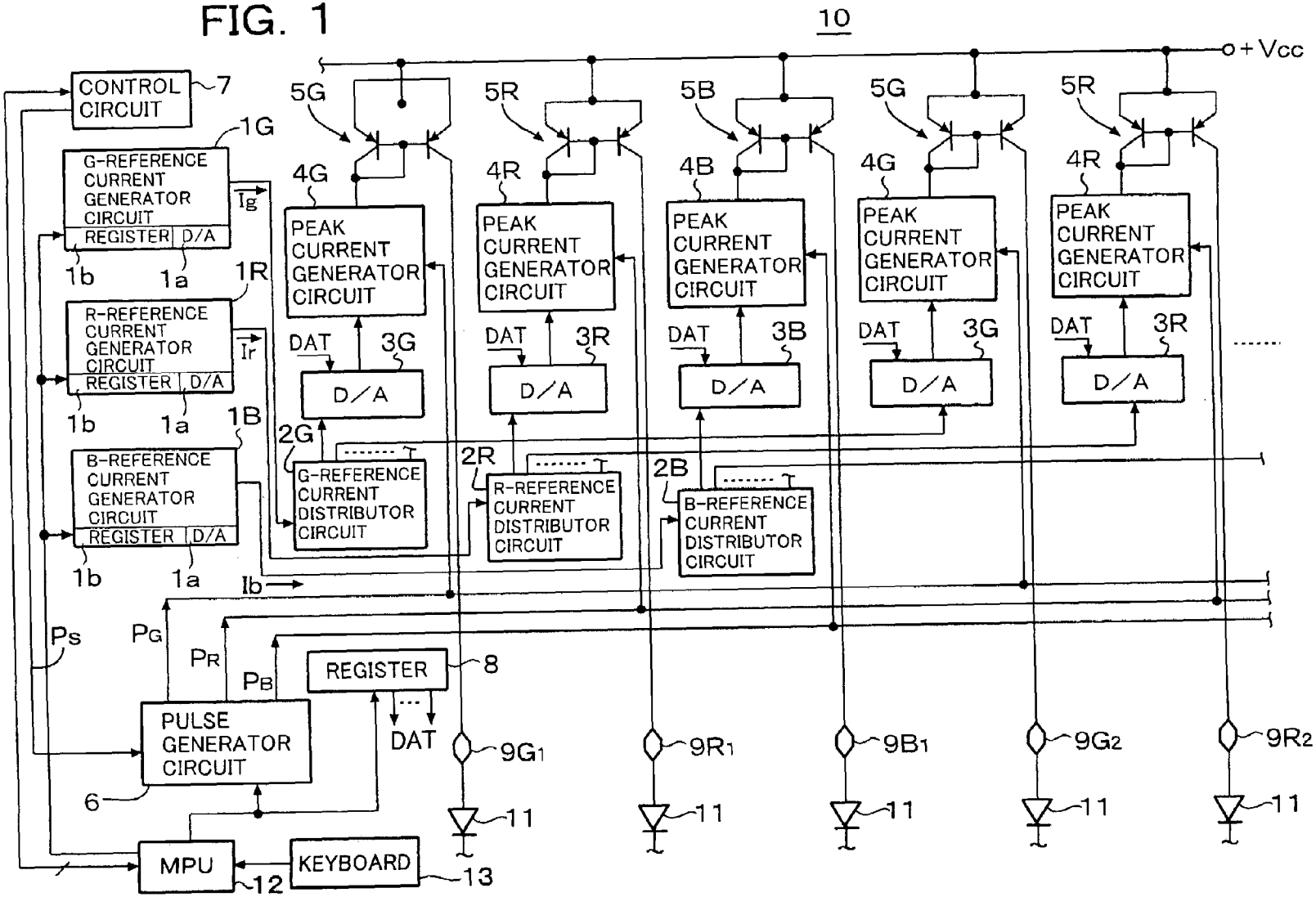
FIG. 1 is a block circuit diagram of an organic EL display panel including an organic EL element drive circuit as a column driver thereof, according to an embodiment of the present invention.

In FIG. 1, a column driver 10 as an organic EL element drive circuit of an organic EL display panel, which is provided as an IC chip, includes reference current generator circuit 1G (G-reference current generator circuit 1G), reference current generator circuit 1R (R-reference current generator circuit 1R) and reference current generator circuit 1B (B-reference current generator circuit 1B) for respective G, R and B display colors and reference current distributor circuit 2G (G-reference current distributor circuit 2G), reference current distributor circuit 2R (R-reference current distributor circuit 2R) and reference current distributor circuit 2B (B-reference current distributor circuit 2B) provided correspondingly to the respective reference current generator circuits 1G, 1R and 1B.

The reference current distributor circuits 2G, 2R and 2B are constituted with current mirror circuits each having one input and multiple outputs. The reference current distributor circuits copy reference currents Ig, Ir and Ib as mirror currents corresponding to the output pins for R, G and B display colors and drive D/A converter circuits 3G, 3R and 3B, which are provided correspondingly to the respective output pins thereof, with reference currents Ig, Ir and Ib, respectively.

The output pins of the current mirror circuits take in the form of pads provided on the IC chip and are connected to respective column pins of the organic EL display panel through gold bumps, gold balls, solder bumps or solder balls. Therefore, as shown in FIG. 1, the output pins correspond to column pins 9G1, 9R1, 9B1, 9G2, 9R2, 9B2, . . . , respectively.

Incidentally, the copied and distributed reference currents may be k×Ig, m×Ir and n×Ib where k, m and n are predetermined constants, respectively. Each of the reference current generator circuits 1G, 1R and 1B includes a D/A converter circuit 1*a* and a register 1*b*, both of which are of, for example, 4 bits and constitute a current value regulator circuit. In order to achieve the white balance regulation, an input data for determining pulse widths are supplied from an MPU 12 and set in the registers 1*b* and the D/A converter circuits 1*a* of the reference current generator circuits 1G, 1R and 1B convert the data into analog values and the reference currents Ig, Ir and Ib, which are regulated according to the data for respective G, R and B display colors, are generated. Thus, the reference currents Ig, Ir and Ib can be regulated within relatively narrow dynamic ranges by the current value regulator circuit.

In response to display data DAT supplied from the MPU 12 through a register 8, the D/A converter circuits 3G, 3R and 3B amplify the reference drive currents Ig, Ir and Ib distributed by the reference current distributor circuits 2G, 2R and 2B and generate drive currents IG, IR and IB corresponding to luminance of the organic EL elements for G, R and B display colors. The drive currents IG, IR and IB are supplied to output stage current sources 5G, 5R and 5B, which have current mirror constructions, through peak current generator circuits 4G, 4R and 4B to drive the corresponding output current sources 5G, 5R and 5B, respectively.

The column pins 9G1, 9R1, 9B1, 9G2, 9R2, 9B2, . . . , are output pins of the column drivers 10. The column pins are connected to anodes of the organic EL elements 11 having cathodes connected to lines of a row side scan circuit (not shown). The output currents (drive currents) of the output stage current sources 5G, 5R and 5B are supplied to the corresponding column pins 9G1, 9R1, 9B1, 9G2, 9R2, 9B2, . . . .

A pulse generator circuit 6 is a programmable pulse generator circuit for generating pulses having programmable pulse width.

Responsive to a timing pulse PG for peak current generation for G display color from the pulse generator circuit 6 for generating a pulse having a programmable width, the peak current generator circuit 4G generates a peak current IPG, which is the usual drive current IG multiplied with M, where M is an integer such as 10, for only the programmed pulse width period. Similarly, the peak current generator circuit 4R receives a timing pulse PR for peak current generation for R display color from the pulse generator circuit 6 for generating a pulse having a programmable width and generates a peak current IPR, which is the usual drive current IR multiplied with M, for only the programmed pulse width period and the peak current generator circuit 4B receives a timing pulse PB for peak current generation for B display color from the pulse generator circuit 6 for generating a pulse having a programmable width and generates a peak current IPB, which is the usual drive current IB multiplied with M for only the programmed pulse width period.

Figure 3:
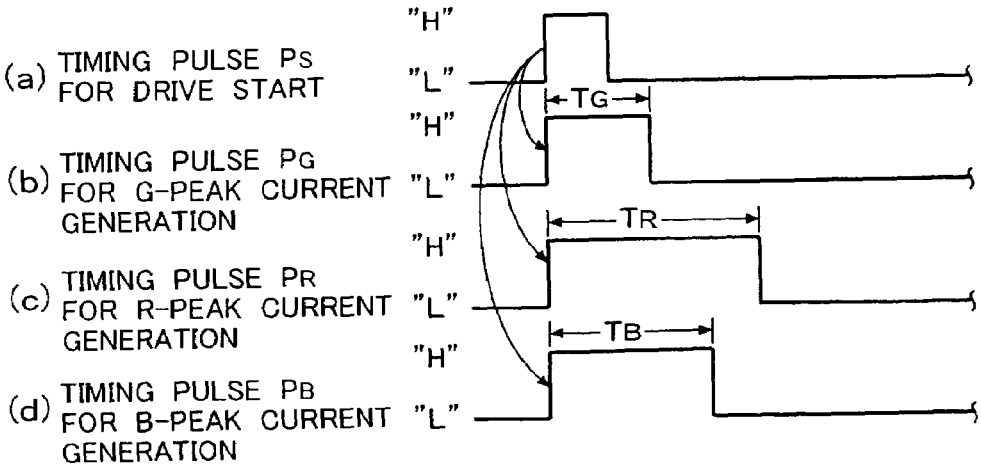
FIG. 3 is a timing chart of peak current generation for respective R, G and B display colors.

The generation timing of the timing pulses PG, PR and PB in the pulse generator circuit 6 is determined according to a timing pulse Ps from a control circuit 7. The timing pulse Ps determines drive start times of organic EL elements for respective G, R and B display colors, as shown in FIG. 3. In FIG. 3, the pulse widths TG, TR and TB of the timing pulses PG, PR and PB are determined according to an input data for regulation of white balance, which is supplied from the MPU 12. The input data are inputted manually to the MPU 12 through a keyboard 13 by an operator who is monitoring the display on the display screen.

The input data are stored in a non-volatile memory, etc., provided in the MPU 12. For example, the input data stored in the MPU 12 are transferred from the MPU 12 to the pulse generator circuit 6 when a power source switch of the organic EL display panel is turned ON. The pulse generator circuit 6 determines the pulse widths of the pulses TG, TR and TB by storing the data in a memory such as RAM thereof and generates the timing pulses PG, PR and PB having the respective pulse widths by a logic circuit included therein on the basis of values of the input data, as shown in FIG. 3.

The pulse generator circuit 6 may generate the timing pulses PG, PR and PB according to an externally supplied clock signal CLK. In such case, a preset counter, etc., is provided in the pulse generator circuit 6 and data corresponding to the pulse widths are externally set in the preset counter. The data are counted by the preset counter as the pulse widths.

The set data of the registers 1*b* of the respective reference current generator circuits 1G, 1R and 1B may be set therein similarly.

Incidentally, the set data may be one, which is changeable after inputted.

The control circuit 7 generates, in addition to the timing pulse Ps, various timing signals related to the column side and row side scans under control of the MPU 12, etc. The timing pulse Ps is a sync signal for scan line driving of the row side scan circuit or a signal corresponding thereto. The cathodes of the organic EL elements 11 are grounded by using this timing pulse Ps, to supply the output currents to the respective column pins to thereby cause the EL elements to emit lights.

As described previously, since the ratio of light emission efficiency for the drive currents for R, G and B display colors is, for example, R:G:B=6:11:10, it is usual that, according to the white balance regulation, the pulse widths TG, TR and TB of the timing pulses PG, PR and PB becomes TG<TB<TR.

Figure 2:
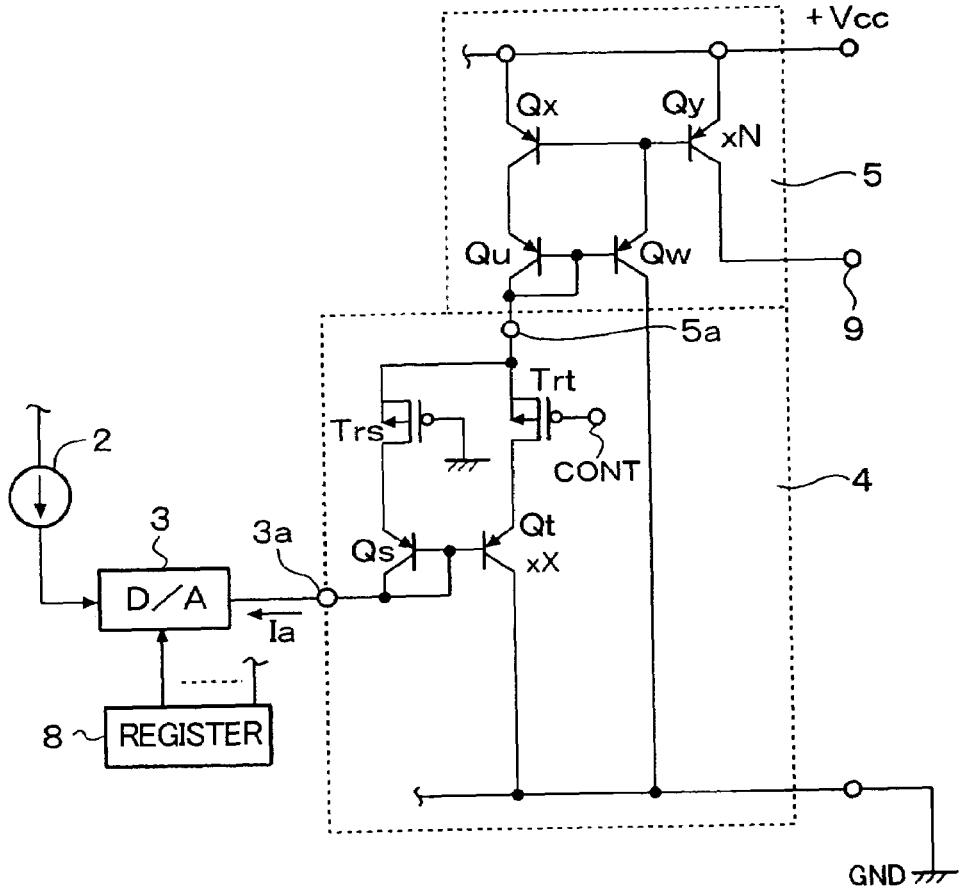
FIG. 2 is a circuit diagram of one of peak current generator circuits of the organic EL element drive circuit shown in FIG. 1, which is provided for output pins of the panel.

FIG. 2 shows a concrete circuit diagram of one of the current drive circuits of the column driver 10.

The D/A converter circuits 3G, 3R and 3B shown in FIG. 1 have identical constructions and the D/A converter circuit is depicted by a reference numeral 3 in FIG. 2. Similarly, the peak current generator circuits 4G, 4R and 4B have identical constructions and the output stage current sources 5G, 5R and 5B have identical constructions shown in FIG. 1. In FIG. 2, the peak current generator circuit and the output stage current source are depicted by reference numerals 4 and 5, respectively.

The current drive circuit shown in FIG. 2 includes the D/A converter circuit 3, the peak current generator circuit 4 and the output stage current source 5. A constant current source 2 corresponds to one of the reference currents Ig, Ir and Ib from the reference current distributor circuits 2G, 2R and 2B.

The peak current generator circuit 4 includes an input side PNP type bipolar transistor Qs and an output side PNP type bipolar transistor Qt. Emitters of the bipolar transistors Qs and Qt are connected to an input terminal 5*a* of the output stage current source 5 through P channel MOS FET transistors Trs and Trt, respectively.

A collector of the input side transistor Qs is connected to an output terminal 3*a* of the D/A converter circuit 3 and a collector of the output side transistor Qt is grounded. A ratio of emitter areas of the transistors Qs and Qt is 1:x. Assuming that the output current of the D/A converter circuit 3 is Ia, a drive current of (x+1)×Ia can be generated at the input terminal 5*a*.

That is, the peak current generator 4 generates the drive current, which is (x+1) times the output current Ia of the D/A converter circuit 3, when the transistor Trt is in ON state. The transistor Trs is a load transistor provided correspondingly to the transistor Trt and has a gate grounded in order to balance the drive line. Incidentally, the transistor Trt is supplied at the terminal CONT with the timing pulse shown in FIG. 3 from the pulse generator circuit 6 for a constant time period in an initial drive period and becomes ON in a period for which the timing pulse is in "H" level. That is, the peak current generator circuit 4 receives the timing pulse PG when the current drive circuit is for G display color. Similarly, the peak current generator circuit 4 receives the timing pulse PR when the current drive circuit is for R display color and the peak current generator circuit 4 receives the timing pulse PB when the current drive circuit is for B display color.

Therefore, an input side PNP type transistor Qx of the output stage current source 5 is driven through PNP type current-mirror transistors Qu and Qw provided for correcting a base current. As a result, the current of (1+x)×Ia flows for the constant peak drive time in which the transistor Trt is turned ON by the input side transistor Qx. And then, the drive current Ia is outputted as a usual drive current. The drive current including the peak current is amplified N times by the PNP type output side transistor Qy of the output stage current source 5 and outputted to the column pin 9, which is any one of the column pins 9G1, 9R1, 9B1, 9G2, 9R2, 9B2, of the organic EL display panel.

Incidentally, the ratio of emitter areas of the transistors Qx and Qy of the output stage current source 5 is 1:N. The emitters of these transistors are connected to a power source line +Vcc, which is in a range, for example, from +15V to +20V. The collector of the output side transistor Qy is connected to the column pin 9.

Thus, the current drive circuit drives the column pin 9 when the drive current including the peak current of N×(1+x)×Ia is supplied thereto. Therefore, the organic EL element 11 having the capacitive load characteristics is initially charged with the peak current and then driven with the current Ia.

In this embodiment, the peak current periods for G, R and B display colors are regulated by the timing pulses PG, PR and PB whose pulse widths are regulated according to the externally set input data for white balance. However, it is possible according to the present invention to further regulate white balance by regulating the reference currents Ig, Ir and Ib by means of the D/A converter circuits, etc., of the respective reference current generator circuits 1G, 1R and 1B as in the conventional manner.

Further, although the peak current generator circuit is provided between the D/A converter circuit and the output stage current source in this embodiment, it may be precedent to the D/A converter circuit.

As described previously, the ratio of light emission efficiency for the drive currents of R, G and B display colors is currently about R:G:B=6:11:10 and a difference in light emission efficiency between G and B display colors is smaller than a difference between R display color and G or B display color. Therefore, the same timing pulse may be used for both G and B display colors. In the latter case, the difference of the light emission efficiency between G and B display colors can be absorbed by regulating the reference currents Ig and Ib of the respective reference current generator circuits 1G and 1B, so that white balance can be regulated. Further, since the difference of light emission efficiency between G and B display colors is small, it is possible to use a single reference current generator circuit instead of the reference current generator circuits 1G and 1B.

The invention claimed is:

1. An organic EL element drive circuit for current-driving terminal pins of an organic EL display panel, which are provided correspondingly to R, G and B display colors, by supplying output currents thereto, comprising:

a plurality of peak current generator circuits provided correspondingly to said terminal pins, for generating peak currents corresponding to widths of predetermined pulse signals; and a pulse generator circuit for generating the predetermined pulse signal, the predetermined pulse signal including a first, second and third pulses having pulse widths determined according to data, which is set externally, the first pulse being supplied to a plurality of said peak current generator circuits provided correspondingly to said terminal pins for R display color, the second pulse to a plurality of said peak current generator circuits provided correspondingly to said terminal pins for G display color and the third pulse to a plurality of said peak current generator circuits provided correspondingly to said terminal pins for B display color.

2. An organic EL element drive circuit as claimed in claim 1, wherein a generation timing of the first, second and third pulses defines a start timing of light emission of said organic EL elements, the width of the first pulse is larger than that of the second or third pulse and said peak current generator circuits generate the peak currents having periods corresponding to the pulse widths, respectively.

3. An organic EL element drive circuit as claimed in claim 2, further comprising a reference current generator for generating reference currents for the respective G, R and B display colors, wherein said pulse generator circuit is a programmable pulse generator circuit for generating pulses having programmable pulse width, a plurality of said peak current generator circuits corresponding to said terminal pins for R display color generate the peak currents according to the reference current for R display color, a plurality of said peak current generator circuits corresponding to said terminal pins for G display color generate the peak currents according to the reference current for G display color and a plurality of said peak current generator circuits corresponding to said terminal pins for B display color generate the peak current according to the reference current for B display color.

4. An organic EL element drive circuit as claimed in claim 3, further comprising a plurality of first D/A converter circuits and a corresponding number of current sources, both of which are provided correspondingly to said terminal pins, wherein each of said peak current generator circuits for R display color is provided between each of said first D/A converter circuits and each of said current sources, which are provided correspondingly to said terminal pins for R display color, each of said peak current generator circuits for G display color is provided between each of said first D/A converter circuits and each of said current sources, which are provided correspondingly to said terminal pins for B display color, said first D/A converter circuits for R, G and B display colors receive either the reference currents corresponding to respective R, G and B display colors or drive currents derived from the reference currents and display data, D/A convert the display data according to the reference currents or the drive currents and drive said peak current generator circuits according to currents obtained by the D/A conversion, and the display data is inputted externally of said organic EL element drive circuit.

5. An organic EL element drive circuit as claimed in claim 4, wherein each said current source is constructed with a current mirror circuit, said reference current generator includes three reference current generator circuits provided correspondingly to respective R, G and B display colors and current values of the reference currents of said reference current generator circuits are set according to the data, which is set externally.

6. An organic EL element drive circuit as claimed in claim 5, wherein each said reference current generator circuit includes a second D/A converter circuit for D/A converting the data set externally of said reference current generator circuit and the data D/A converted by said second D/A converter circuit is inputted externally of said organic EL element drive circuit.

7. An organic EL element drive circuit as claimed in claim 4, wherein the second pulse and the third pulse are identical.

8. An organic EL element drive circuit as claimed in claim 7, wherein each said current source is constituted with a current mirror circuit, said reference current generator includes three reference current generator circuits provided correspondingly to respective R, G and B display colors and current values of the reference currents of said reference current generator circuits are set according to the data set externally.

9. An organic EL element drive circuit as claimed in claim 8, wherein each said reference current generator circuit includes a second D/A converter circuit for D/A converting the data set externally of said reference current generator circuit and the data D/A converted by said second D/A converter circuit is inputted externally of said organic EL element drive circuit.

10. An organic EL element drive circuit as claimed in claim 9, wherein said reference current generator circuits for B and G display colors are constituted with a single reference current generator circuit and the second pulse and the third pulse are a same pulse.

11. An organic EL element drive circuit for current-driving terminal pins of an organic EL display panel, which are provided correspondingly to R, G and B display colors, by supplying output currents thereto, comprising:

a first peak current generator circuit provided correspondingly to said terminal pins for R display color for adding a peak current having a period and a predetermined value corresponding to a pulse width of a first pulse predetermined pulse signal to the output current;

a second peak current generator circuit provided correspondingly to said terminal pins for G display color for adding a peak current having a period and a predetermined value corresponding to a pulse width of a second pulse predetermined pulse signal to the output current;

a third peak current generator circuit provided correspondingly to said terminal pins for B display color for adding a peak current having a period and a predetermined value corresponding to a pulse width of a third pulse predetermined pulse signal to the output current; and a programmable pulse generator circuit for generating the first, second and third pulses having programmable pulse widths determined according to data, which is set externally thereof, with a predetermined timing.

12. An organic EL element drive circuit as claimed in claim 11, further comprising a plurality of D/A converter circuits and current sources corresponding in number to said D/A converter circuits, said D/A converter circuits and said current sources being are provided correspondingly to said terminal pins, each said D/A converter circuits being adapted to D/A-convert the display data according to a current as a reference for a current-drive of said organic EL display panel, wherein each of said first peak current generator circuits for R display color is provided between each of said D/A converter circuits and each of said current sources for R display color, each of said second peak current generator circuits for G display color is provided between each of said D/A converter circuits and each of said current sources, which are provided correspondingly to said terminal pins for G display color, each of said third peak current generator circuits for B display color is provided between each of said first D/A converter circuits and each of said current sources, which are provided correspondingly to said terminal pins for B display color, the predetermined timing for generating the first, second and third pulses is a timing for starting light emission of said organic EL elements.

13. An organic EL element drive circuit as claimed in claim 12, wherein each said current source is constructed with a current mirror circuit, the reference currents are generated by reference current generator circuits each having a second D/A converter circuit and the reference currents for respective R, G and B display colors are generated according to data set in said second D/A converter circuits externally thereof.

14. An organic EL display device having said organic EL element drive circuit as claimed in claim 1.

15. An organic EL display device as claimed in claim 14, further comprising a processor, wherein the data set in said pulse generators or said programmable pulse generator circuit and the data set in said reference current generator circuits are set by said processor according to data inputted thereto.

* * * * *